US006226972B1

(12) United States Patent
Kida

(10) Patent No.: US 6,226,972 B1
(45) Date of Patent: May 8, 2001

(54) TWISTED UNION YARN MANUFACTURING METHOD AND DEVICE

(75) Inventor: Kazuyoshi Kida, Ishikawa-Ken (JP)

(73) Assignee: Izumi International, Inc., Greenville, SC (US)

( * ) Notice: Subject to any disclaimer, the term of this patent is extended or adjusted under 35 U.S.C. 154(b) by 0 days.

(21) Appl. No.: 09/246,822

(22) Filed: Feb. 8, 1999

Related U.S. Application Data

(63) Continuation-in-part of application No. 09/205,893, filed on Dec. 4, 1998.

(30) Foreign Application Priority Data

| | | |
|---|---|---|
| Dec. 10, 1997 | (JP) | 9-362264 |
| Feb. 9, 1998 | (JP) | 10-27397 |
| Jul. 30, 1998 | (JP) | 10-215991 |

(51) Int. Cl.[7] ..... D01H 5/00

(52) U.S. Cl. ..... 57/293; 57/344; 242/615.1

(58) Field of Search ..... 57/293, 344, 346, 57/348; 474/181, 182, 183, 146, 152; 242/615.1, 615.2; 254/413, 415

(56) References Cited

U.S. PATENT DOCUMENTS

| | | | | |
|---|---|---|---|---|
| 2,256,436 | | 9/1941 | Kruse | 57/1 |
| 2,430,944 | | 11/1947 | Noguera | 57/128 |
| 2,702,982 | | 3/1955 | Guyot | 57/34 |
| 3,043,084 | | 7/1962 | Smith | 57/77.3 |
| 3,128,922 | * | 4/1964 | Luketa | 254/415 |
| 3,225,533 | | 12/1965 | Henshaw | 57/34 |
| 3,363,409 | | 1/1968 | Schwabe et al. | 57/77.3 |
| 3,388,891 | * | 6/1968 | De Meo | 254/415 |
| 3,415,048 | | 12/1968 | Welbers | 57/34 |
| 3,635,008 | | 1/1972 | Guy | 57/77.4 |
| 3,670,487 | | 6/1972 | Dragisich | 57/77.3 |
| 3,672,091 | * | 6/1972 | Cloutier | 254/195 |
| 3,680,302 | | 8/1972 | Hess et al. | 57/34 HS |
| 3,732,677 | | 5/1973 | Seem et al. | 57/77.3 |
| 3,791,388 | * | 2/1974 | Hunter et al. | 57/140 |
| 3,983,686 | | 10/1976 | Raschle | 57/77.3 |
| 4,033,103 | | 7/1977 | Vukoje | 57/34 HS |
| 4,206,589 | | 6/1980 | Markey et al. | 57/293 |
| 4,325,537 | * | 4/1982 | Winter et al. | 254/413 |
| 4,351,146 | | 9/1982 | Faure et al. | 57/6 |
| 4,581,883 | * | 4/1986 | Streppel | 57/290 |
| 4,771,701 | * | 9/1988 | Schippers | 254/415 |
| 5,094,068 | * | 3/1992 | Hirao | 57/341 |
| 5,618,009 | * | 4/1997 | Foster et al. | 242/615.1 |
| 5,725,200 | * | 3/1998 | Gordon | 254/415 |

FOREIGN PATENT DOCUMENTS

| | | | |
|---|---|---|---|
| 0 022 421 | | 1/1981 | (EP) . |
| 1 283 332 | | 6/1962 | (FR) . |
| 2 344 656 | | 10/1977 | (FR) D01H/7/92 |
| 1139445 | | 4/1966 | (GB) . |
| 07066824 | * | 2/1995 | (JP) . |

* cited by examiner

*Primary Examiner*—John J. Calvert
*Assistant Examiner*—Gary L. Welch
(74) *Attorney, Agent, or Firm*—Leatherwood Walker Todd & Mann, P.C.

(57) ABSTRACT

To provide a method and device with which Alternate Twisted Yarn can be produced simply and inexpensively. An Alternate Twisted Yarn is produced by alternately repeating with a neutral and tilt switching method and twisting yarn 1 in the reverse direction on both sides of pulley 2 driven by yarn 1 that is inserted between the flanges of pulley 2, so that the yarn passage is bent or flexed. Shaft 3 of this pulley 2 is inclined to the yarn 1 yarn passage plane to bring yarn 1 into contact with the flange section 2*a*'s internal surface of pulley 2, and in the neutral position under which yarn 1 is not twisted on both sides of pulley 2, with shaft 3 of pulley 2 being made perpendicular to the yarn 1 yarn passage plane to cut off its contact to the pulley 2 flange section 2*a*'s internal surface.

16 Claims, 7 Drawing Sheets

TWISTED UNION YARN MANUFACTURING METHOD AND DEVICE

This application is a continuation-in-part of Ser. No. 09/205,893 filed Dec. 4, 1998.

BACKGROUND OF THE INVENTION

This invention covers the method and equipment in manufacturing Alternate Twisted Yarns whose twisting direction differs alternately in the yarn's longitudinal direction (the S twist area and Z twist area exist alternately).

Since irregular crimping can be produced by post-processing by such an Alternate Twisted Yarn, it is possible to manufacture the seersucker texture and wrinkled texture easily.

As a means for manufacturing this Alternate Twisted Yarn, this inventor has already suggested this method in the Official Gazette of Patent OPI Pub. 1996-246280. In this suggestion, a raw yarn is drawn out continuously or intermittently from the supply bobbin (which is fixed) and the raw yarn thus drawn out is inserted and passed to the twisting equipment rotating intermittently in one direction for intermittent twisting, which is then to be heat set after it is wound on to the take-up bobbin. The twisting equipment illustrated is such that the roller provided with a V-groove for rolling the yarn in the rotating cylindrical body's internal center is inserted at right angles to the shaft, and a nipper is provided to hold the yarn, utilizing centrifugal force. In any case, the yarn is to be twisted by means of the cylindrical body's rotation when passing through the said cylindrical body, and the twisting applied to the yarn is exactly opposite from the approach side to the delivery side on the twisting equipment.

In this case, the total number of twists generated on the twisting equipment's approach side and the delivery side is the same. However, since the yarn is wound on to the take up bobbin even during the twisting equipment's intermittent rotation stop period, the yarn twist on the twisting equipment's approach-side is sent to the delivery side through the twisting equipment, thereby untwisting the yarn on the delivery side, so that the twist is eliminated if this state were to continue. In reality, since the yarn on the delivery side cannot be untwisted because it is wound on to the take-up bobbin, the number of twists remaining on the delivery-side yarn becomes fewer than the total number of twists on the approach side. Extra twist sent to the delivery side from the approach side is wound on to the take-up bobbin as opposite twist in relation to the previous twist (i.e. S twist then next Z twist). Next, the twisting equipment restarts its intermittent rotation, newly twisting the yarns on the approach side and the delivery side in the reverse direction on the delivery side. The remaining yarn is untwisted just as it was in the earlier stages which is followed by new twisting, and then the rotation stops so that the aforementioned phenomenon occurs once again. Hence, the repeated rotation and stopping phenomenon described above continually repeats, thus producing the Alternate Twisted Yarn.

However, the above suggested equipment had a problem in that the cylindrical body which functions as a twisting device is rotated by a positive drive device in the yarn twisting direction. The rotation and stop must be repeatedly and alternately controlled, which in turn makes the twisting equipment's structure complicated, and the equipment cost, operating expenses, maintenance and control costs or the like are expensive.

SUMMARY OF THE INVENTION

The inventor proposes this invention with the above-mentioned problems taken into account. The aim of this invention is to provide the method and equipment for manufacturing Alternate Twisted Yarn in which both are simple and inexpensive.

In order to achieve the aforementioned purpose, this invention was made to manufacture Alternate Twisted Yarn by alternately repeating the operations of twisting yarn in the opposite direction on both sides of the pulley by intermittently bringing the yarn into contact with the pulley flange's internal surface by which such contact drives the pulley itself with the yarn passage inserted between the pulley flanges so that the yarn is flexed or bent around the pulley with the shaft of this pulley inclined in relation to the yarn travelling plane in order to twist the yarn in the opposite direction on both sides of the pulley. In order to drive the yarn in the neutral state in which no yarn is twisted on both sides of the pulley, the contact to the pulley flange's internal surface is cut off by shifting the pulley shaft so that it is made perpendicular to the yarn passage plane.

In other words, if the yarn is inserted between the pulley flanges so that its passage is bent or flexed, the grooved bottom of the pulley coming into contact with this yarn is thus driven with frictional force by means of the yarn travelling due to the yarn winding on to the take up package.

Further, if the pulley shaft is inclined in relation to the yarn passage plane, the yarn approaching the pulley comes into contact with one (for example, the upper side) flange's internal surface inside the pulley groove, while the yarn sent out of the pulley contacts the other (for example, the lower side) flange's internal surface.

In this case, since the grooved bottom section is rotated with frictional force by the travelling yarn in the pulley, and the rotation direction in the pulley flange section is nearly perpendicular to the yarn passage direction, the yarn contacting this rotating pulley flange's interior will be twisted because of this contact on the inside surface of the pulley flange.

Further, since the yarn on the approach side is contacting the inside of one side of the pulley's two flanges and the yarn is contacting the inside of the opposite side of the pulley's two flanges on the delivery side, the twist applied to the yarn becomes reversed on the pulley's approach side in relation to the pulley's delivery side, i.e., S twist on the approach side of the pulley and Z twist on the delivery side of the pulley.

On the other hand, if the pulley shaft is made perpendicular to the yarn passage plane, the yarn will be placed in the neutral condition in which it does not contact either side of the pulley's flanged interior surface. Therefore, as the yarn travels, it only contacts the grooved bottom of the pulley. Accordingly, no yarn is twisted. Since the yarn continues to travel, the twist applied to the yarn at the pulley's approach side passes through the pulley, which is then sent out to the delivery side. Thus, it follows that the same phenomenon occurs as explained in the Conventional Technology paragraph described above, and if this process is repeated, Alternate Twisted Yarn will be produced.

In this way, according to this invention, the method for rotating and driving the twisting equipment by a positive drive device, which is required by the conventional technology, is not required. That is, in this invention, an Alternate Twisted Yarn can be manufactured by only repeating the operations of inclining the pulley shaft and returning it to the neutral position.

In this invention, the pulleys comprise several front-stage pulleys arranged in parallel and one rear stage pulley; the yarn passage of several yarns travelling in parallel are inserted between the pulley flanges on several front stage pulleys (one yarn end per front stage pulley) where the yarn passage is bent or flexed. Next, the several yarns are assembled and passed through an eyelet and are inserted between the flanges of the rear stage pulley with the yarn passage bent or flexed. The shafts of each front stage pulley and rear stage pulley are tilted in any mode by means of computer control in order to manufacture a variety of Alternate Twisted Yarn. The varieties of Alternate Twisted Yarn are produced by the different combinations of tilting modes among the mutual front stage pulleys and the combinations of tilting modes by the rear stage pulley. These tilting mode combinations can be obtained simply and easily by a computer software changeover or the like.

Further, this invention was made to manufacture a variety of Alternate Twisted Yarns by inclining the pulley shaft's tilting direction to the yarn passage plane in the reverse (left hand and right hand) direction alternately to the neutral position.

Further, in this invention, the aforementioned pulley should be of a dual construction, composed of an internal roller for forming the base of the pulley and an external pulley for forming the two flanges of the pulley. The internal roller rotates freely while the rotation speed as well as the direction of the external pulley is controlled in the forward and reverse rotation direction. The intention of this dual constructed pulley is to enable the manufacturing of a greater variety of Alternate Twisted Yarns.

This invention also makes it possible to implement the Alternate Twisted Yarn manufacturing method by installing a pulley that rotates freely in the center of the yarn passage. The yarn is inserted between the pulley flanges so that the yarn passage is bent or flexed and a neutral position and a tilted position changeover device is supplied in order to change this pulley shaft to the neutral position which is perpendicular to the yarn passage plane and the tilted twisting position which is nearly perpendicular to the yarn passage plane.

Furthermore, in this invention, the aforementioned pulley should be of a dual construction, composed of an internal roller for forming the inside grooved base of the pulley and an external pulley for forming the two flanges of the pulley. The internal roller rotates freely while the rotation speed as well as the direction for the external pulley is controlled in the forward and reverse direction. The rotation speed of this external pulley can be controlled by a motor or an air nozzle assembly in which the air nozzles control the rotation direction of the external pulley and the air pressure from the air nozzle assembly controls the speed (RPM) of the external pulley, whereby the method for manufacturing a great variety of Alternate Twisted Yarns can be implemented.

Furthermore, this invention makes the surface of the flange interior of the said pulley rough, thereby improving the twist applied to the yarn.

Furthermore, this invention makes the contour profile on the outer circumference surface of the flange section on the said pulley polygonal and oval, and dissimilar, thereby giving variety to the Alternate Twisted Yarn.

Furthermore, this invention makes it so that one can replace one or all of the front stage pulleys and/or the back stage pulley with a twist spindle device that is positively driven such that the yarn ends are passed through the front stage twist spindles (one yarn end per front stage spindle); these yarn ends are assembled and are passed through an eyelet and then passed through a rear stage twist spindle. The twisting action of the twist spindles is regulated by a computer controller in which one can achieve a higher twist to the Alternate Twisted Yarn thus providing a greater variety of Alternate Twisted Yarn.

DESCRIPTION OF THE PREFERRED EMBODIMENT

Figure 1:
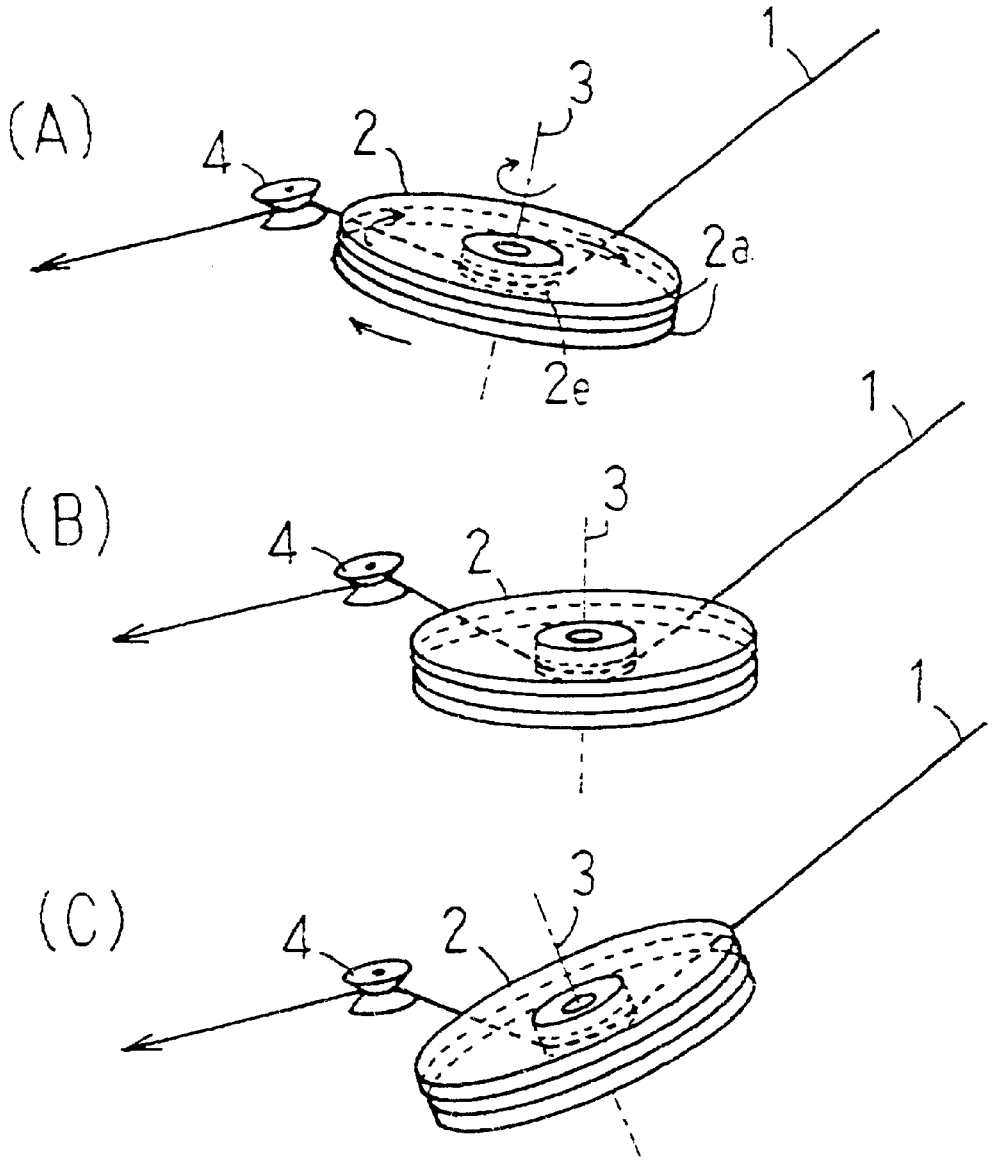
FIG. 1 illustrates configurations (A), (B) and (C) and are the oblique drawings for explanation of the principle for the Alternate Twisted Yarn manufacturing method according to this invention; (A) and (C) show the condition in which the pulley shafts are inclined mutually in the reverse direction, and (B) shows the neutral position.

In FIG. 1, (A), (B) and (C) are the oblique drawings for the principle explanation of the Alternate Twisted Yarn manufacturing method according to this invention. (A), (B) and (C) in FIG. 2 are the side views for the principle explanation of the Alternate Twisted Yarn manufacturing method according to this invention.

Figure 2:
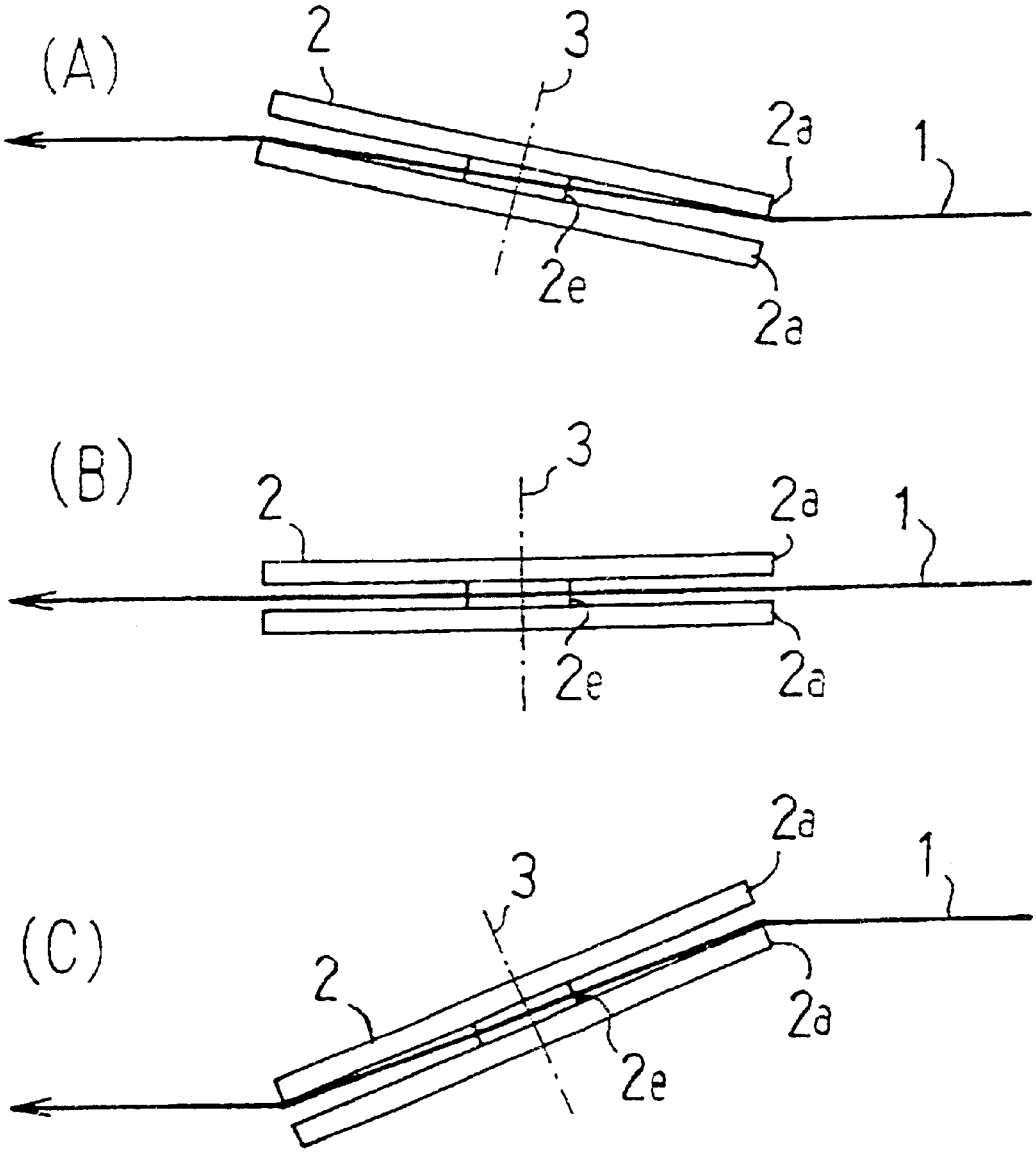
FIG. 2 illustrates configurations (A), (B) and (C) and are the side views for explanation of the principle for the Alternate Twisted Yarn manufacturing method according to this invention; (A) and (C) show the condition in which the pulley shafts are inclined mutually in the reverse direction, and (B) shows the neutral position.

The Alternate Twisted Yarn manufacturing method according to this invention is to manufacture an Alternate Twisted Yarn by repeating the operations alternately; as shown in FIG. 1 and FIG. 2, by inserting yarn 1 into the yarn passage of on pulley 2 in the middle so that the yarn passage is flexed or bent and inclining shaft 3 of this pulley 2 in relation to the yarn 1 passage plane to bring yarn 1 into contact with interior flange section 2*a* of pulley 2 for the yarn passage, thereby producing reverse direction twisting in yarn 1 on both sides of pulley 2, and making shaft 3 of pulley 2 perpendicular to the yarn 1 passage plane to cut off yarn 1 contact to interior flange section 2*a* of pulley 2 and driving yarn 1 in the neutral position in which yarn 1 is not twisted on both sides of pulley 2. The pulley 2 used should preferably have a deep groove.

The yarn passage of yarn 1 may be in the course, for example, from the package bobbin to the take-up package bobbin. FIG. 1 illustrates the case using auxiliary pulley 4, which is not an essential member.

The said pulley 2 illustrates the case where the flexural angle of yarn 1 travelling path is nearly 90 degrees, but this angle can be set to any flexural angle, such as 0 degrees or larger and 180 degrees or smaller.

Figure 3:
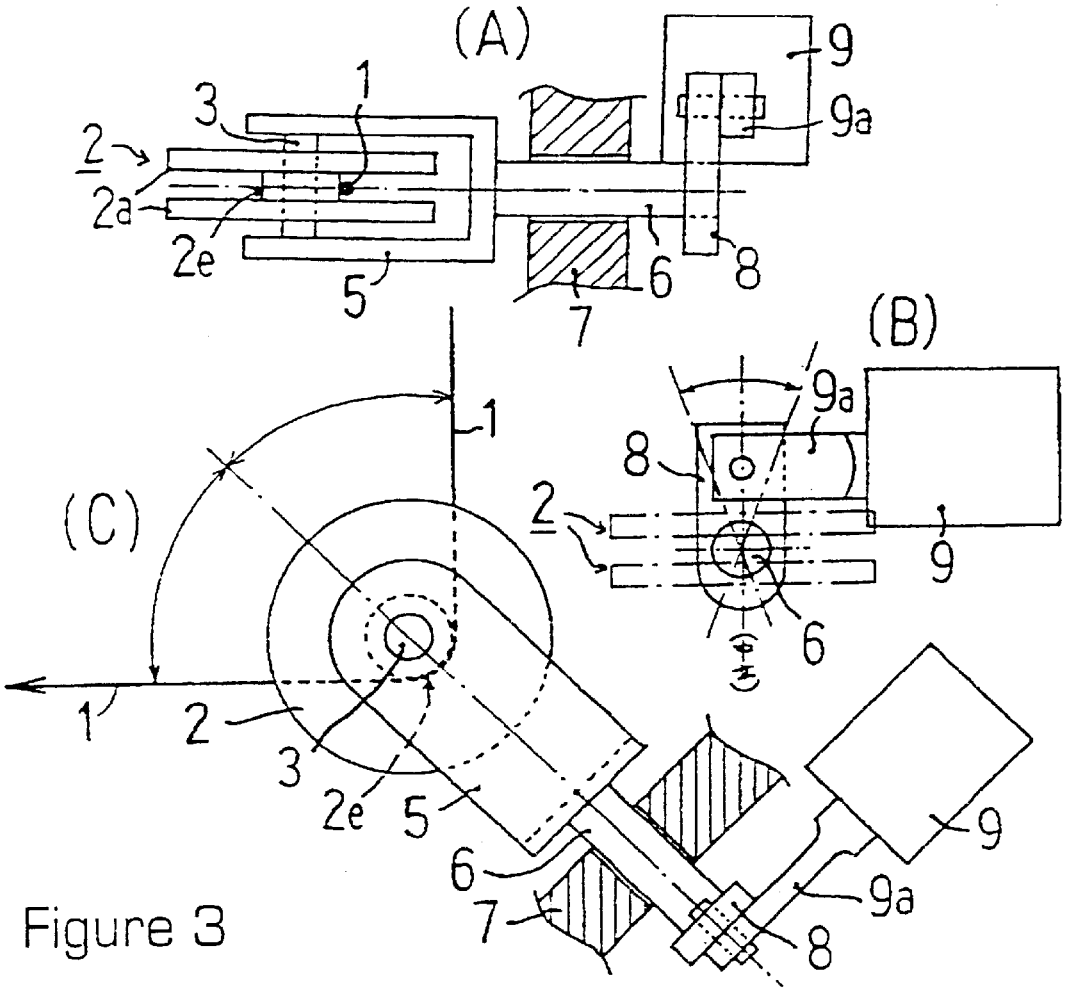
FIG. 3 is a partial cross sectional side view showing the first embodiment of the pulley used in this invention, (B) is the end face drawing as viewed from its right side, and (C) is its cross sectional top view.

Support member 5 of pulley 2 is, as shown in FIG. 3, a system for supporting shaft 3 of pulley 2 by supporting both sides of shaft 3, this support member 5 may also be set to support just one side of shaft 3 of pulley 2 such as a cantilever system.

Support member 5 of shaft 3 of pulley 2 pivotally supports appropriate stationary member 7 around neutral and tilting changeover shaft 6, which is switched through lever 8 by operating member 9*a* of neutral and tilting changeover means 9 in order to change shaft 3 of pulley 2 to the neutral position perpendicular to the yarn 1 yarn passage plane and to the tilting position for contacting the yarn 1 in order to produce twist.

The said neutral and tilting changeover method 9 may be comprised by an air cylinder, rotary solenoid, cam and other appropriate methods. Lever 8 can also be switched manually.

The said neutral and tilting changeover shaft 6 is pivotally supported by stationary member 7 on the plane in which the yarn 1 yarn passage is formed and on the bisector of the flexural angle for yarn 1's travelling path.

In this case, shaft 3 of pulley 2 may be inclined to the yarn passage plane in only two positions—neutral position and right side position by means of the neutral and tilting changeover device 9. Shaft 3 of pulley 2 may also be inclined in the reverse direction alternately on the right and left sides to the neutral position for switching in three positions. It is possible to produce more varieties of Alternate Twisted Yarns with three positions rather than in two positions.

Figure 4:
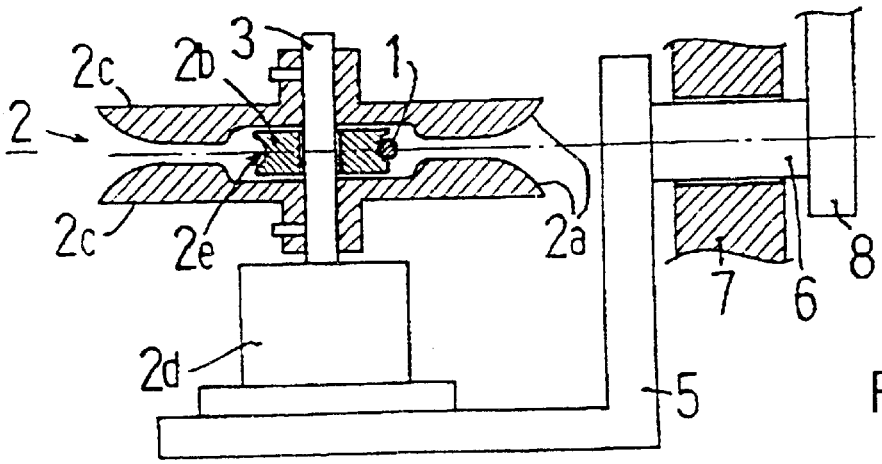
FIG. 4 is a cross sectional side view showing the second embodiment of the pulley used in this invention.

FIG. 4 shows other embodiments of pulley 2 used in this invention. Pulley 2 in this embodiment is internally and externally of a dual construction comprised of internal roller 2*b* for forming the grooved bottom and external pulley 2*c* for forming the flange section. Internal roller 2*b* is pivotally engaged with shaft 3 and rotates freely, while external pulley 2*c* is fixed to shaft 3, which can be controlled in the forward and reverse rotation directions along with the rotation speed through the use of an appropriate control unit by motor 2*d*. This configuration makes it possible to give the yarn 1 a higher or lower twist as desired which in turn produces a greater variety of Alternate Twisted Yarns.

Figure 5:
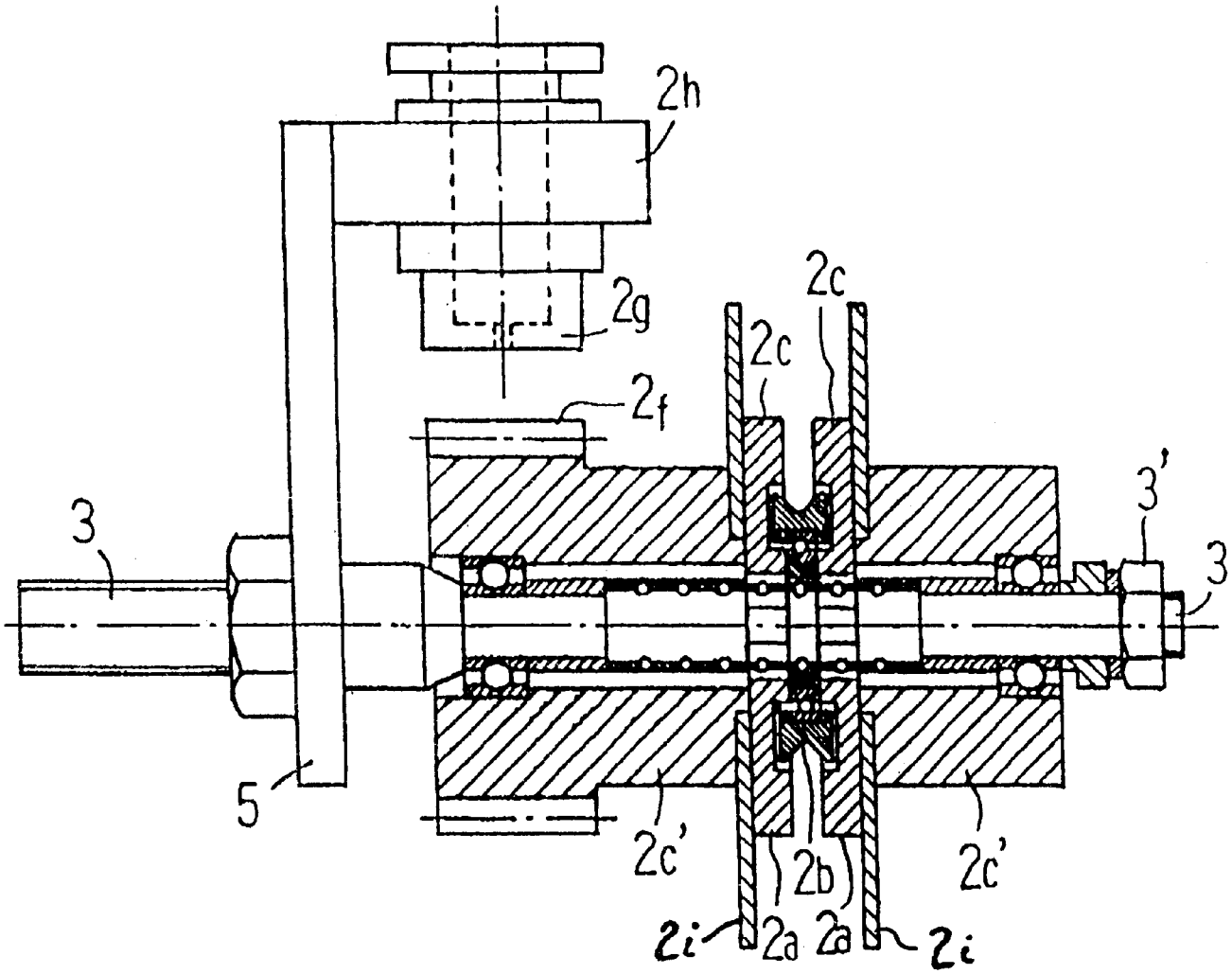
FIG. 5 is a cross sectional side view showing the third embodiment of the pulley used in this invention.

FIG. 5 shows another embodiment of pulley 2 used in this invention. Pulley 2 in this embodiment comprises internal roller 2*b* for forming the groove bottom and external pulley 2*c* for forming the flange section which are pivotally secured to shaft 3 by another bearing for both. The external pulley 2*c* for forming the flange section is to be rotated according to the air motor principle. Specifically, the impeller unit 2*f* is formed on the outer circumference section of boss unit 2*c*' or 2*c*' of the external pulley flanges 2*c* and 2*c*, and external pulley flanges 2*c* and 2*c* form the flange unit on both sides of internal roller 2*b* for forming the grooved bottom.

Air nozzle 2*g* is provided via holder 2*h* as a part of support member 5 of shaft 3 This air nozzle 2*g* is attached in a tangent line in relation to impeller unit 2*f*, and two air nozzles are provided symmetrically for forward and reverse rotation. Air with the regulated pressure is, in an alternative way, supplied via the pressure control valve and changeover valve from the air supply source to air nozzle 2*g* or 2*g*, and when occasion demands, the arrangement is made so that the speed (RPM) and rotation direction is adjusted and controlled, depending on the degree of differential pressure by supplying air to both air nozzles 2*g*, 2*g* in parallel with differential pressure. External pulleys 2*c* and 2*c* for forming the flange unit on both sides in FIG. 5 described above are tightened on shaft 3 with nut 3' so that these pulleys rotate as one body. Air protecting circular plates 2*i*, 2*i* are provided in boss units 2*c*' and 2*c*' of external pulleys 2*c* and 2*c* for forming the flange unit on both sides so that no air adversely affects the travelling yarn.

This invention also allows for a rough surface on the interior flange unit 2*a* of said pulley 2, thereby making it possible to improve the twisting to yarn 1. The material of this pulley 2 may be of metal, synthetic resin or ceramic. It may be necessary to take precautions for static electricity generated due to contact with yarn 1. It is preferable to make arrangements so that yarn 1 can be made static-free. Further, for the said pulley 2, the contour profile on the outer circumference surface of flange unit 2*a* may be made not circular but polygonal, oval and otherwise dissimilar. This arrangement diversely changes the twisting to yarn 1, further making it possible to manufacture Alternate Twisted Yarn full of variety.

The first embodiment of this invention contains the configuration described above, and explanation is given below for the procedure of manufacturing the Alternate Twisted Yarn by referring to FIG. 1 and FIG. 2.

First, as shown in FIG. 1, if yarn 1 is inserted on to pulley 2 so that its yarn passage is flexed or bent, the groove bottom of pulley 2 contacting this yarn 1 will be rotated with frictional force due to yarn 1 travelling by yarn 1 winding on to the take up package or the like.

Further, as shown in (A) or (C) in FIG. 2, if shaft 3 of pulley 2 is tilted in relation to the yarn 1 yarn passage plane, yarn 1 approaching to pulley 2 will come into contact with one (for example, upper side for A) flange 2*a*'s internal surface of the groove of pulley 2, while yarn 1 delivered from pulley 2 contacts the other (for example, lower side for A) flange 2*a*'s internal surface of the groove of pulley 2.

In this case, for pulley 2, the grooved bottom unit 2*e* rotates by the travelling yarn 1 with frictional force, and the rotation direction of flange unit 2*a* of pulley 2 is nearly perpendicular to the yarn 1 yarn passage direction (Refer to (A) and (C) in FIG. 1), so that yarn 1 coming into contact with flange unit 2*a*'s internal surface of this rotating pulley 2 is to be twisted between pulley 2 and the appropriate support point (illustration omitted) in the approach side upstream, and between pulley 2 and delivery-side auxiliary pulley 4 due to flange unit 2*a*'s internal surface of pulley 2.

Further, since the flange unit 2*a* internal surface of pulley 2 yarn 1 contacts is touching opposite sides on the pulley 2 approach side and delivery side as shown in (A) or (C) in FIG. 2, the twisting given to yarn 1 is exactly opposite on the pulley 2's approach than it is on pulley 2's delivery side. In other words, in the state shown in (A), yarn 1 on the approach side is twisted clockwise, while yarn 1 on the delivery side is twisted counterclockwise. In the state of (C), the yarn twist is reversed.

On the other hand, as shown in (B) in FIG. 1 and (B) in FIG. 2, where shaft 3 of pulley 2 is made perpendicular to the yarn 1 yarn passage plane, yarn 1 is not contacting the flange unit 2*a* internal surface of pulley 2, which comes into contact with only the groove bottom unit 2*e* of pulley 2 for rotating pulley 2. Therefore, yarn 1 is not twisted. Since yarn 1 is travelling continuously, however, the twisting applied to the pulley 2 approach side passes through pulley 2 and is sent out to the delivery side. Thus, the delivery side is untwisted due to approach-side twisting. Since the delivery-side twisting, exceeding auxiliary pulley 4, is wound on to the take-up bobbin, etc. in sequence, however, the yarn thus wound up is not untwisted but fixed. Accordingly, the yarn from which the twist already wound on to take-up bobbin is subtracted is to be untwisted, but since the number of twists on the approach side is larger, this twisting remains, which is then wound on to the take-up bobbin in succession. This twisting is reverse to the preceding twisting, whereby it follows that the yarn has different twisting direction is wound up continuously. Next, if shaft 3 of pulley 2 is tilted again, the same twisting as described above is changed in the reverse direction each other on both sides of pulley 2. If shaft 3 of pulley 2 returns to the neutral, the reverse direction twisting is wound on to the take-up bobbin according to the phenomenon as described above. Hereafter, if this is repeated, an Alternate Twisted Yarn will be manufactured.

As explained above, this invention applies to the yarn passage path of a yarn twisting machine and yarn assembling machine or the like, and also applies to the weaving yarn preparation process for the manufacturing of seersucker texture and wrinkle processing texture, etc., which is best suited to using Alternate Twisted Yarn in its manufacturing process.

Figure 6:
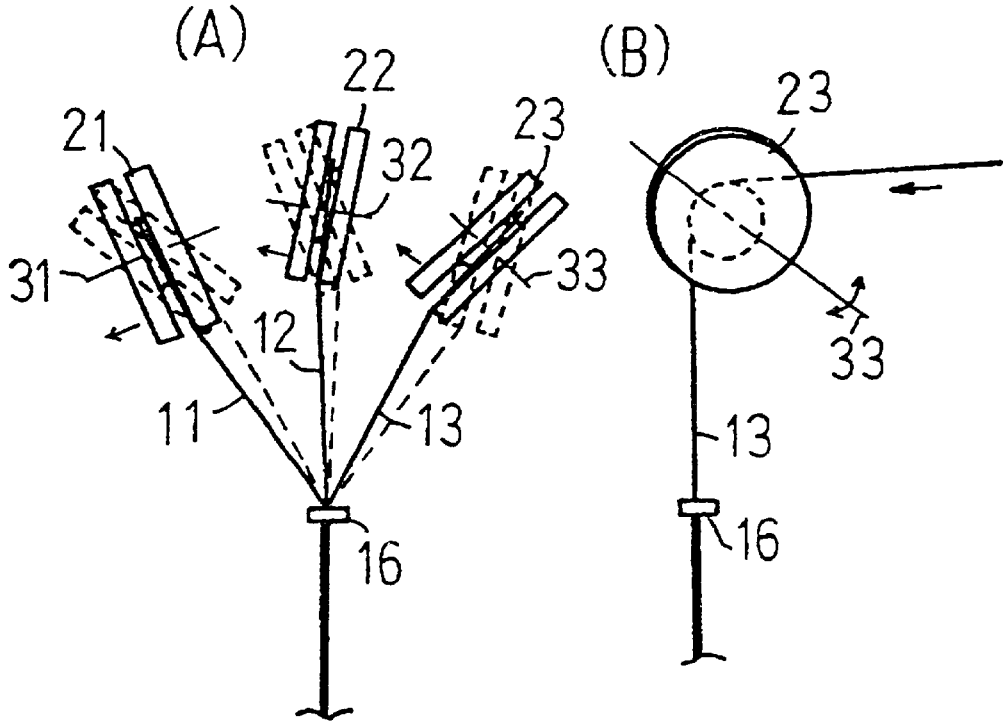
FIG. 6 illustrates configuration (A), which is the outline top view showing the second embodiment in this invention, and (B) is its side view.
Figure 6:
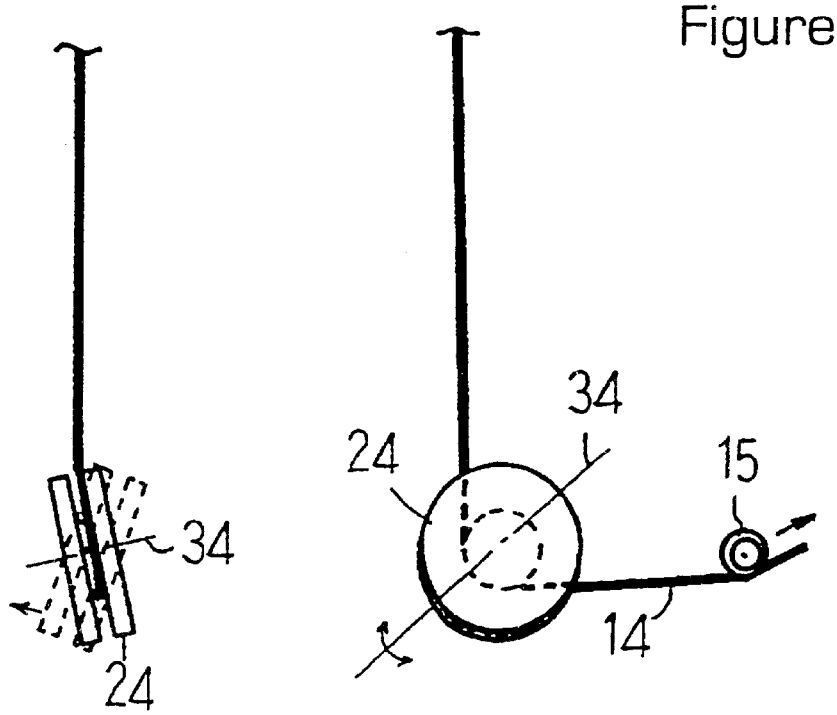
Figure 7:
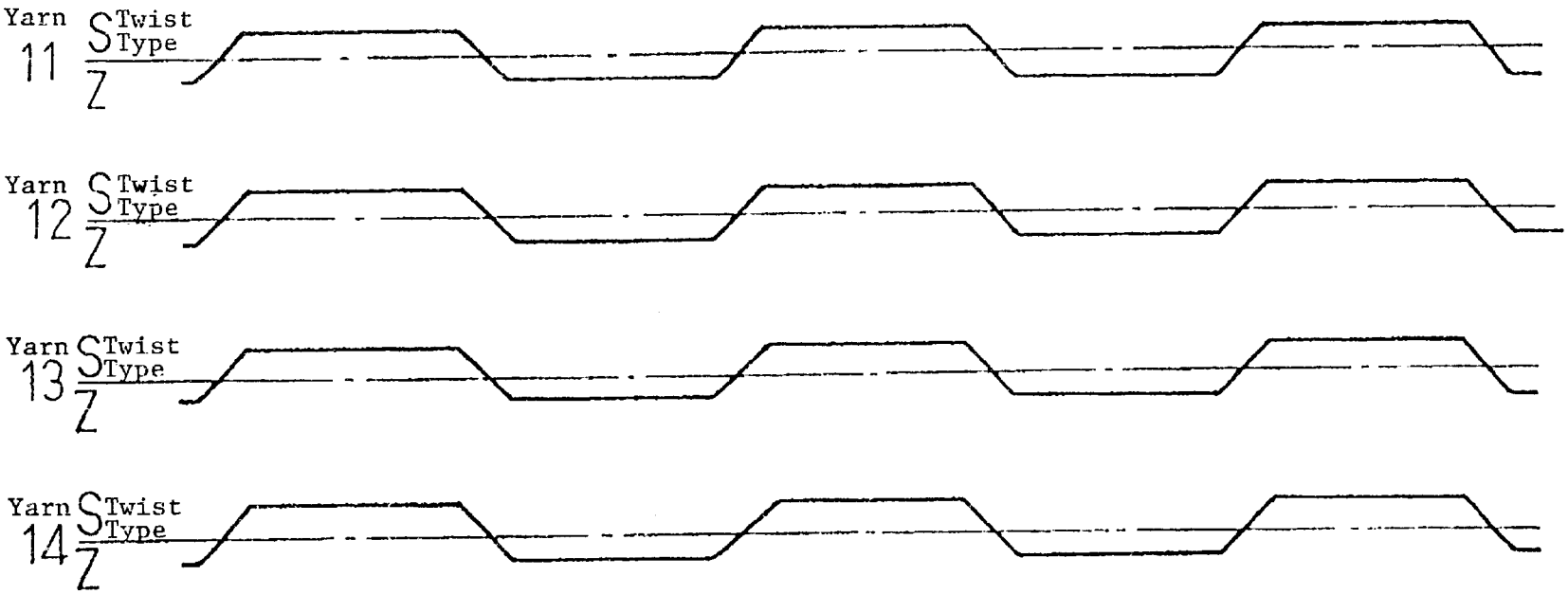
FIG. 7 is an explanatory drawing showing a sample formation of Alternate Twisted Yarn in the second embodiment of this invention.

Next, referring to FIG. 6 (A), (B) and FIG. 7, explanation is given of the 2nd embodiment of this invention is as shown in FIG. 6 (A) & (B), composed of several (3 pulleys in the Figure) front-stage pulleys 21, 22, 23 arranged in parallel and one rear-stage pulley 24; several (3 yarns in the Figure) yarns 11, 12, 13 travelling in parallel are inserted between the flanges of several front-stage pulleys 21, 22, 23 so that the midpoint of yarn travelling path is flexed or bent, then the yarn is assembled and passed through an eyelet 16, the assembled yarns are inserted between the flanges of the rear-stage pulley 24 for flexural travelling, which are sent out via auxiliary pulley 15 to the take-up machine side, and shafts 31, 32, 33 of each front-stage pulley 11, 12, 13 and shaft 34 of rear-stage pulley 24 are tilted in any mode by means of computer control so that many varieties of Alternate Twisted Yarn 14 is manufactured. Each front-stage pulley 21, 22, 23 and rear-stage pulley 24 apply to the configuration shown in FIGS. 3 to 5.

Since the 2nd embodiment of this invention is configured as described above, for example, where each front-stage pulley 21, 22, 23 and rear-stage pulley 24 are inclined alternately as shown by the dotted lines and solid lines at the same time, as shown in FIG. 7, 3 twisted yarns 11, 12, 13 synchronously applied with S twist & Z twist by front-stage pulleys 21, 22, 23 are assembled, and yarn 14 additionally applied with S twisting & Z twisting synchronously with the said three yarns is obtained by rear-stage pulley 24.

Furthermore, in FIG. 6 (A), if shafts 31, 33 of two front-stage pulleys 21, 23 on the outside are inclined in the reverse direction, yarns 11, 13 on both sides will be twisted counterclockwise, and according to the difference in tilting modes between mutual front-stage pulleys and combinations of rear-stage pulley tilting modes by means of computer control, such as varying the shaft inclination switching period for pulleys 21 to 24, and starting base point, Alternate Twisted Yarns with different variations can be obtained simply and easily.

Figure 8:
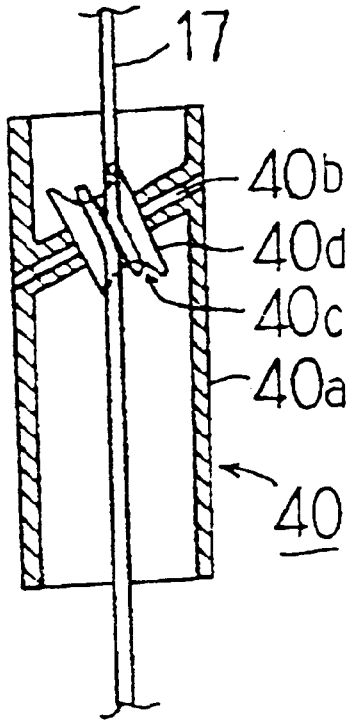
FIG. 8 is the cross section view of the twist spindle used in this invention.

Furthermore, in this invention shown in FIG. 6 the front stage pulleys 21, 22, 23 and rear stage pulley 24 can be replaced in any combination with a twister spindle shown in FIG. 8 where the twister spindle is positively driven to apply twist to yarn 17 in order to produce Alternate Twisted Yarns.

The twist spindle 40 as shown in FIG. 8 is provided with support shaft 40*b* inclined to the inside of cylindrical body 40*a*. The grooved pulley 40*d* is equipped with a U- or V-groove 40*c* for wrapping the yarn on the outer circumference is pivotally secured in the center of this support shaft. The cylindrical body is shaft supported with a bearing (not illustrated) on its outer circumference side, which is coupled to the rotary drive source that can be rotated clockwise and counter clockwise. This rotary drive source can be an electrical motor and/or an air motor. Further, the support shaft 40*b* that bears grooved pulley 40*d* of the twist spindle is offset from the center of the cylindrical body 40 by the distance nearly equal to the radius of the grooved pulley 40*d* so that the pullout end of the yarn 17 set over groove 40*c* of the grooved pulley 40*d* falls on the center shaft line of cylindrical body 40.

The twist spindle 40 is arranged with the center shaft of cylindrical body 40*a* matched with the yarn passage line. The yarn 17 is inserted into the cylindrical body 40*a* and is wrapped around the grooved pulley 40*d* only once, which is drawn out from the opposite side. Since the grooved pulley 40*d* is secured to the inclined support shaft 40*b*, both ends of the yarn 17 wrapped around the grooved pulley are drawn out from the groove 40*c*, whereby the yarn entering the grooved pulley 40*d* does not contact the yarn exiting the grooved pulley. By using such a grooved pulley, it is possible to avoid the problem where the yarn on the entrance side and the exit side rub each other. In particular, when a stronger twist is applied to the yarn on the entrance side and makes contact with the untwisted yarn on the exit side this will generate fluff or cause entanglement thus causing yarn breakage.

According to the method in this invention, a means for positively rotating and driving the twisting equipment as found in the current unit is not required; that is, in this invention, an Alternate Twisted Yarn can be produced by only inclining the pulley shaft or returning it to the neutral position repeatedly.

Also, this invention comprises two types of pulleys including several front-stage pulleys arranged in parallel and single rear-stage pulley; the midposition of the yarn passage of several yarns travelling in parallel is inserted between the flanges of several front stage pulleys where the yarn passage is bent or flexed, then the yarn is assembled and passed through an eyelet and this assembled yarn is inserted between the flanges of the one rear stage pulley where the assembled yarn passage is bent or flexed, and tilting motion is given to each front-stage pulley shaft and rear-stage pulley shaft in any mode by means of computer control in order to produce many options of Alternate Twisted Yarn. It is, therefore, possible to simply and easily obtain Alternate Twisted Yarns with different variations according to the difference in tilting modes between mutual front-stage pulleys and combinations of rear-stage pulley tilting modes by simple changing of computer software or the like.

Further, in this invention, many varieties of Alternate Twisted Yarns can be produced by tilting the direction for inclining the pulley shaft in relation to the yarn passage plane in the reverse direction alternately to the neutral position.

Furthermore, in this invention, the said pulley is of a dual construction internally and externally comprising the inside roller for forming the grooved bottom and an outside pulley for forming the flange section. The inside roller rotates freely, and for the outside pulley, the forward and reverse rotation direction and rotation speed can be controlled, thereby making it possible to produce many varieties of Alternate Twisted Yarns.

In addition to the above, according to the equipment of this invention, an Alternate Twisted Yarn can be produced at a reasonable cost with a simple configuration. Also, in this invention, the said pulley flange's internal surface is made rough, thus making it possible to improve the yarn twisting function. Further, in this invention, the contour profile on the outer circumference surface of the flange section of said pulley is made polygonal, oval and otherwise dissimilar, thereby making it possible to give a significant variety to the yarn twisting function.

Furthermore, this invention makes it so that one can replace one or all of the front stage pulleys and/or the back stage pulley with a twist spindle device that is positively driven such that the yarn ends are passed through the front stage twist spindles (one yarn end per front stage spindle); these yarn ends are assembled and are passed through an eyelet and then passed through a rear stage twist spindle. The twisting action of the twist spindles is regulated by a computer controller in which one can achieve a higher twist to the Alternate Twisted Yarn thus providing a greater variety of Alternate Twisted Yarn.

DESCRIPTION OF REFERENCE NUMERALS

1 Yarn
2 Pulley
2*a* Flange section
2*b* Inside (Internal) pulley
2*c* Outside (External) pulley
2*d* Motor
2*e* Groove bottom section
3 Shaft
4 Auxiliary pulley
5 Support member
6 Neutral & tilting changeover shaft
7 Stationary member
8 Lever
9 Neutral & tilting switching means
9*a* Operating member
11–14 Yarn
21–23 Front-stage pulley
24 Rear stage pulley
31–34 Shaft

What is claimed is:

1. An alternate twisted yarn manufacturing method for twisting yarn, comprising:

providing the yarn and a pulley having a shaft and pulley flanges;

alternately repeating the operations in which the yarn is inserted in a yarn passage formed between the pulley flanges so that a flexure state is obtained, the shaft of the pulley being inclined in relation to the yarn passage plane to bring the yarn into contact with an inside portion of at least one of the flanges of the pulley as the yarn travels through the pulley, thereby generating twist in an opposite direction in the yarn entering the pulley as compared to the yarn exiting the pulley, and moving the pulley shaft to perpendicular in relation to a yarn passage plane so as to eliminate contact between the yarn and the inside flange portions of the pulley, so that the yarn passage is in neutral position, wherein the yarn is not twisted by the pulley.

2. The alternate twisted yarn manufacturing method described in claim 1, including providing pulleys comprised of several front stage pulleys arranged in parallel along with one rear stage pulley; the yarn passage of several yarns travelling in parallel and being inserted between the pulley flanges of several of said front stage pulleys, one yarn end per front stage pulley, so that the yarn passage is bent or flexed; these yarn ends then being assembled and passed through an eyelet and then inserted between the flanges of the one rear stage pulley with the yarn passage bent or flexed, while a tilting motion is given to the shafts of each front stage pulley and the shaft of the rear stage pulley by a computer controller, which controls the tilting to produce a variety of alternate twisted yarns.

3. The alternate twisted yarn manufacturing method defined in claim 2 in which the front stage pulleys or the rear stage pulley or both the front stage pulleys and the rear stage pulleys are replaced by a twist spindle that is positively driven such that the yarn ends are passed through the front stage twist spindles, one yarn end per front stage spindle; these yarn ends then being assembled and passed through an eyelet and then passed through the rear stage twist spindle; the twisting action of the twist spindles being regulated by a computer controller which can be selectively programmed in order to produce a variety of alternate twisted yarns.

4. The alternate twisted yarn manufacturing method described in claim 2 which is characterized in that the direction for inclining the pulley shaft in relation to the yarn passage plane is alternately inclined in the opposite direction to the neutral position.

5. The alternate twisted yarn manufacturing method described in claim 2 which is characterized in that the pulley is of a dual construction, composed of an internal roller for forming an inside grooved base of the pulley and an external pulley for forming flanges of the pulley; the internal roller rotating freely while the rotation speed as well as the direction of the external pulley is controlled in the forward and reverse rotation directions.

6. The alternate twisted yarn manufacturing method described in claim 1 which is characterized in that the direction for inclining the pulley shaft in relation to the yarn passage plane is alternately inclined in the opposite direction to the neutral position.

7. The alternate twisted yarn manufacturing method described in claim 6 which is characterized in that the pulley is of a dual construction, composed of an internal roller for forming an inside grooved base of the pulley and an external pulley for forming flanges of the pulley; the internal roller rotating freely while the rotation speed as well as the direction of the external pulley is controlled in the forward and reverse rotation directions.

8. The alternate twisted yarn manufacturing method described in claim 1 which is characterized in that the pulley is of a dual construction, composed of an internal roller for forming an inside grooved base of the pulley and an external pulley for forming the two flanges of the pulley; the internal roller rotating freely while the rotation speed and the direction of the external pulley is controlled in the forward and reverse rotation directions.

9. An alternate twisted yarn manufacturing device comprising:

a pulley having pulley flanges defining a yarn passage; said pulley being freely rotatable in a plane carrying the yarn passage and said pulley being configured to be driven by movement of the yarn in the yarn passage, the yarn being inserted between the pulley flanges with the yarn passage flexed at an angle;

a pulley shaft connected to said pulley; and a neutral and tilt switching means for changing said pulley shaft to a state perpendicular to the yarn passage plane and to a tilted twisting state, for imparting alternating twist in the yarn.

10. The alternate twisted yarn manufacturing device described in claim 9 which is characterized in that the pulley is of a dual construction composed of an internal roller for forming a grooved base of the pulley and an external pulley for forming the two flanges of the pulley, so that the internal roller rotates freely, and an external pulley controllable in the forward and reverse rotation directions, and including an air nozzle assembly having air nozzles, the rotation speed of said external pulley being controllable by said air nozzle assembly in which the air nozzles control the rotation direction of the external pulley and the air pressure from the air nozzle assembly controls the rotational speed of the external pulley.

11. The alternate twisted yarn manufacturing equipment described in claim 10 characterized in that the pulley flange's internal surface is made rough.

12. The alternate twisted yarn manufacturing equipment described in claim 9 characterized in that the pulley flange's internal surface is made rough.

13. The alternate twisted yarn manufacturing equipment described in claim 9 characterized in that the contour profile on the pulley flange's outer circumference surface is polygonal.

14. The alternate twisted yarn manufacturing equipment described in claim 9 characterized in that the contour profile on the pulley flange's outer circumference surface is made oval.

15. The alternate twisted yarn manufacturing equipment described in claim 9 characterized in that the contour profile on the pulley flange's outer circumference surface is made dissimilar.

16. The alternate twisted yarn manufacturing device described in claim 9 which is characterized in that the pulley is of a dual construction composed of an internal roller for forming a grooved base of the pulley and an external pulley for forming flanges of the pulley, so that the internal roller rotates freely, and an external pulley controllable in the forward and reverse rotation directions, and including a motor and the rotation speed of said external pulley being controllable by said motor.

* * * * *